US007874636B2

(12) United States Patent
Perrin et al.

(10) Patent No.: US 7,874,636 B2
(45) Date of Patent: Jan. 25, 2011

(54) PRINT HEAD CLEANING WITH VACUUM SOURCE AND SOLVENT

(75) Inventors: Max Perrin, Quartier Champfort (FR); Daniel Chalamet, Toumon sur Rhone (FR)

(73) Assignee: MARKEM-IMAJE, Bourg-les-Valence (FR)

( * ) Notice: Subject to any disclaimer, the term of this patent is extended or adjusted under 35 U.S.C. 154(b) by 814 days.

(21) Appl. No.: 11/722,559

(22) PCT Filed: Dec. 22, 2005

(86) PCT No.: PCT/EP2005/057136

§ 371 (c)(1),
(2), (4) Date: Jun. 22, 2007

(87) PCT Pub. No.: WO2006/067227

PCT Pub. Date: Jun. 29, 2006

(65) Prior Publication Data

US 2008/0100660 A1 May 1, 2008

(30) Foreign Application Priority Data

Dec. 23, 2004 (FR) ..... 04 53205

(51) Int. Cl.
*B41J 2/165* (2006.01)
*B41J 2/02* (2006.01)

(52) U.S. Cl. ..... 347/28; 347/73

(58) Field of Classification Search ..... 347/20–36, 347/5, 6, 9, 44, 47, 73, 74, 82, 89
See application file for complete search history.

(56) References Cited

U.S. PATENT DOCUMENTS

| | | | | |
|---|---|---|---|---|
| 5,126,752 | A * | 6/1992 | Weinberg | 347/28 |
| 5,457,484 | A * | 10/1995 | Regnault et al. | 347/74 |
| 6,145,954 | A * | 11/2000 | Moore | 347/28 |
| 6,273,103 | B1 * | 8/2001 | Enz et al. | 134/22.11 |
| 6,398,351 | B1 * | 6/2002 | Blum et al. | 347/84 |
| 6,575,556 | B1 | 6/2003 | Eremity et al. | |
| 6,588,339 | B2 * | 7/2003 | Naniwa et al. | 101/465 |
| 6,869,160 | B2 * | 3/2005 | West et al. | 347/28 |
| 7,175,263 | B2 * | 2/2007 | Colombat et al. | 347/77 |
| 7,182,420 | B2 * | 2/2007 | Nakazawa | 347/7 |

(Continued)

FOREIGN PATENT DOCUMENTS

EP 0424008 4/1991

(Continued)

OTHER PUBLICATIONS

International Search Report dated Apr. 20, 2005.

*Primary Examiner*—Stephen D Meier
*Assistant Examiner*—Alexander C Witkowski
(74) *Attorney, Agent, or Firm*—Pearne & Gordon LLP

(57) ABSTRACT

To clean a print head of an ink jet printer, an ink gun is connected to an ink chamber, a solvent chamber, a vacuum source, and an ink collection gutter, which is capable of being connected in a controlled manner to a vacuum source. During cleaning, an interruption of a hydraulic connection between the gun and the ink chamber is ordered. Next, the gun is connected to the vacuum source. Finally, the solvent chamber is hydraulically connected to the vacuum source via a conduit which includes the ink gun.

15 Claims, 3 Drawing Sheets

U.S. PATENT DOCUMENTS

| | | | | |
|---|---|---|---|---|
| 7,192,121 | B2 | 3/2007 | Barbet et al. | |
| 2004/0104959 | A1 | 6/2004 | Brown et al. | |
| 2005/0122381 | A1 | 6/2005 | Colombat et al. | |
| 2008/0100660 | A1 * | 5/2008 | Perrin et al. | 347/28 |

FOREIGN PATENT DOCUMENTS

| | | |
|---|---|---|
| FR | 2835217 | 1/2002 |
| FR | 2851495 | 2/2003 |

* cited by examiner

PRINT HEAD CLEANING WITH VACUUM SOURCE AND SOLVENT

TECHNICAL FIELD

This invention relates to the field of cleaning print heads of ink jet printers. More specifically, the invention relates to a method for cleaning for a continuous jet printer as well as a print head suitable for this method.

PRIOR ART

The typical operation of a continuous jet printer can be described as follows. Electrically-conductive ink is held under pressure in an ink gun which is part of a print head comprising a body. The ink gun consists of a chamber intended to contain ink to be stimulated, and a recess for a device for periodic stimulation of the ink, for example, a piezoelectric actuator, among others the stimulation chamber comprises, from the inside to the outside, at least one passage for carrying ink to a calibrated nozzle, formed in a nozzle plate. The pressurized ink is discharged from the nozzle, thus forming an ink jet.

The periodic stimulation device housed in the ink gun causes the ink jet to break up at regular time intervals at a point in space; this forced fragmentation of the ink jet is usually caused at a so-called break up point of the jet by periodic vibrations of the stimulation device placed in the ink contained in an ink gun upstream of the nozzle.

From the break up point, the continuous jet is transformed into a series of identical and regularly-spaced ink drops. Near the break up point, a first group of electrodes called "charging electrodes" has the function to selectively transfer, to each drop of the series of drops, a predetermined amount of electric charge. All of the drops of the jet, now charged, then pass through a second arrangement of electrodes called "deflecting electrodes" generating an electric field which will modify the path of the drops according to their charge.

Conventionally, the charged, and therefore deflected, drops are directed toward a substrate to be printed. The undeflected drops, i.e. the drops less charged, are not printed, and are directed toward a collection device commonly called a "gutter". The same continuous jet is therefore intended both for printing and for not printing the substrate in order to produce the desired patterns.

To increase the print surface and therefore the print speed, such continuous deflected jet printers can comprise a plurality of print nozzles operating simultaneously and in parallel. In particular, systems with two nozzles have been developed, in which two guns operate in conjunction. For example, document FR-A-2 835 217 (Imaje) describes a print head including a double nozzle with convergent axes: each nozzle is associated with a set of charging electrodes and deviating electrodes (in fact, one of the deflecting electrodes of each pair may be common). In the case described, the undeflected drops all arrive at the collection gutter, with the axis of the nozzles defining their path converging toward a point on this gutter.

There are also printers that operate on the alternative principle, for example, described in document FR-A-2 851 495 (Imaje), in which the undeflected drops are used for printing. In this case, conventionally, each gun is associated with a plate having a plurality of ejection nozzles.

Regardless of the type of continuous jet printer, it is clear that to satisfy its function, the print head must be hydraulically connected to a pressurized ink chamber intended to supply the ink gun, and to a chamber receiving, in return, the ink not directed toward the print substrate.

Furthermore, in addition to the ink collection and supply connections, the print head is generally connected to an ink solvent chamber. The solvent is intended to regulate the fluidity of the ink in operation, and, during stopping phases, to clean the channels and passages that together form the ink circuit, so as to prevent any dry remainder in the channels. Indeed, dried ink can produce particles causing print defects; the nozzles or filters in the channels can also become blocked. Above all, dried ink alters the values of the channel effective cross-sections, possibly until they are totally obstructed, causing a dysfunction of the print head, or even a malfunction, due to a change to and/or disturbance of the jet. It is therefore necessary to periodically clean the channels and associated elements that form the ink circuit, in particular at the level of the print head, which is the most sensitive element of the circuit.

Document EP-A-0 424 008 (Linx Printing Technology) thus describes cleaning by means of the ink circuit.

In reference to FIG. 1 of this document, an ink and solvent circuit of an ink jet printer comprises an ink chamber (1) and a solvent chamber (29), channels (11, 33) for circulation of the ink, a vacuum source (23) in the channels, and a solenoid system: for ink supply (11), discharge (35), gutter (27), solvent filling (31) and draining (37). As specified (column 4, line 30 to column 5, line 46), the circuit-cleaning operation is performed in two steps.

In the first step, the drain solenoid (37) is open, and solvent from its chamber (29) passes through the drain and ink supply solenoids (37, 11), the ink supply line (13) and the ink gun (15), and returns, through a discharge conduit (33) and the discharge and gutter solenoids (35, 27), to the vacuum source (23) and to the ink chamber (1). This first step of the cleaning operation thus enables the gun (15), the solenoid and the ink supply line (11, 13) to be cleaned.

As also specified in this document, the cleaning of the gutter is less important because the latter is connected to the vacuum source, which normally suctions of any ink that may be located there when the printer is stopped.

The gutter (21) can, however, be cleaned in a second step of the cleaning operation described in EP-A-0 424 008, which is performed under normal printing operation conditions. As the second step is performed immediately after the first step, the ink supply line (13) and the gun (15) are initially full of solvent. This solvent is flushed by the ink which arrives under pressure from the ink chamber (1), through the ink supply line (13), then from the gun (15) through the nozzle of said gun and returns to the vacuum source (23) in particular through the gutter (21) and the gutter suction conduit (25) which are thus cleaned.

This method admittedly has the advantage of not requiring means for pressurizing the solvent other than those necessary for the ink; however, the method involves ink-solvent and solvent-ink transitions in the flow through the nozzle of the gun. These transitions lead to directional instability of the jet leaving the nozzle, which requires complex compromises and changes to the shape and configuration of the nozzle, causing problems in the definition of this element which is essential for good printing. It also renders the ink jet direction susceptible to move toward the charging or deflecting electrodes and to be deposited there, and even to dry there: the wet or dried ink causes changes to the surface of the electrodes and therefore to the equipotential surfaces in the zone through which the jet passes, so that the nominal value of the potential created at the level of these zones will be different from the commanded value. In addition, the soiling caused by this ink leads to a dysfunction of any of the electrodes; a short-circuit may even occur in some cases.

DESCRIPTION OF THE INVENTION

The invention aims to overcome these risks of instability of the jet during ink-solvent-ink transitions, while properly cleaning all of the conduits and the gun.

In one embodiment, the invention relates to a method for cleaning the ink passing through the conduits, a gun and a collection gutter of a print head, which has the advantages of simplicity of the aforementioned patent application, while preventing the spray of solvent from the nozzle. In particular, there is no ink-solvent-ink transition since the gun projects only ink and never solvent.

More specifically, the invention relates to a method for cleaning a print head of an ink jet printer comprising an ink gun, connected, by means of devices capable of being controlled, to an ink chamber, a solvent chamber and a vacuum source. The method according to the invention comprises, after a print phase, the following steps:

(1) interruption of a hydraulic connection between the gun and the ink chamber, so that the gun is no longer supplied with ink, (2) establishment of a connection between the gun and the vacuum source, so that the ink in the gun is suctioned toward the vacuum source. Any ink meniscus formed at the level of the ink ejection nozzle is thus suctioned, and the ink jet is cleanly stopped.

(3) establishment of a hydraulic connection between the solvent chamber and the vacuum source via a circuit comprising the ink gun. In this way, solvent circulates in the gun, but, due to the vacuum in the gun, the solvent pressure in the gun is insufficient for said solvent to flow through the nozzle: the diameter of the nozzle is too small to allow the solvent to pass if the pressure is insufficient. Thus, the gun is cleaned without ejection of solvent through the nozzle.

Optionally, in the period during which the solvent chamber is connected to the vacuum source via a circuit comprising the ink gun, the connection between the ink gun and the vacuum source is repeatedly and instantaneously cut off. "Instantaneous cut-off" means a cut-off that is separated from the reopening of the connection by a minimum amount of time, in particular by the minimum latency between a cut-off and a reopening, taking into account the inertia of the material means used in order to achieve it. This enables the nozzle to be cleaned even when no jet is established, and, in particular, when there is no ejection of solvent from the nozzle, resulting in a fully cleaned gun at the end of the process.

The print head can also comprise an ink collection gutter connected, by means of a device capable of being controlled, to a vacuum source, possibly the same as the vacuum source connected to the gun. Although it is not essential, as the cleaning of the gutter and the collection conduits is preferred, in an alternative of the method according to the invention, a connection is established between the collection gutter and the solvent chamber, preferably for a very short time so that the solvent only moistens the gutter without flooding it. Simultaneously, while the gutter is supplied with solvent, a connection is established between the gutter and the vacuum source, for a series of time periods shorter than the period for which the gutter is connected to the solvent source. In this way, the solvent in the gutter is agitated in alternating directions of flow, before it is suctioned, and the gutter and the collection conduit are cleaned.

The invention also relates to starting up a print head of an ink jet printer comprising an ink gun, connected, by means of devices capable of being controlled, to an ink chamber, a solvent chamber, and a vacuum source, after a stopping phase during which the gun is filled with solvent. A preferred embodiment of this method is as follows:

(1) a connection is established between the gun and the vacuum source;

(2) as the connection between the gun and the vacuum source is kept open, periods in which the gun is connected to the ink chamber are alternated with periods in which this connection is interrupted;

(3) the connection between the gun and the vacuum source is interrupted, and the connection between the ink chamber and the gun is kept open.

In this way, only ink having the predetermined properties, namely of viscosity, and capable of printing the substrate as desired is ejected from the nozzles.

The invention also relates to a print head of an ink jet printer capable of performing the cleaning process according to the invention, including at least one ink gun and a collection gutter, which comprises a collection solenoid which controls a connection between a vacuum source and the collection gutter, a solenoid for washing the gun which controls a connection between a solvent chamber and the gun, a discharge solenoid which controls a direct connection (not including the nozzle) between the gun and a vacuum source, and, finally, an ink solenoid which controls a connection between an ink chamber and the gun. Advantageously, a solenoid for washing the collection gutter, controlling a connection between the collection gutter and a solvent chamber, is also present.

The solenoids are preferably located in the same recess.

The print head can advantageously comprise two guns and two nozzles, each being connected to a hydraulic circuit enabling it to be cleaned according to the invention.

It is specified that the solvent chamber, the ink chamber, and the vacuum source(s) are not part of the print head. The solenoids close off and open conduits which themselves are connected or can be connected, respectively, to these elements.

BRIEF DESCRIPTION OF THE DRAWINGS

The features and advantages of the invention can be better understood from the reading of the following description and in reference to the appended drawings, showing an embodiment of an ink jet printer capable of implementing the method of the invention, given by way of an illustrative but non-limiting example.

DETAILED DESCRIPTION OF SPECIFIC EMBODIMENTS

Figure 1:
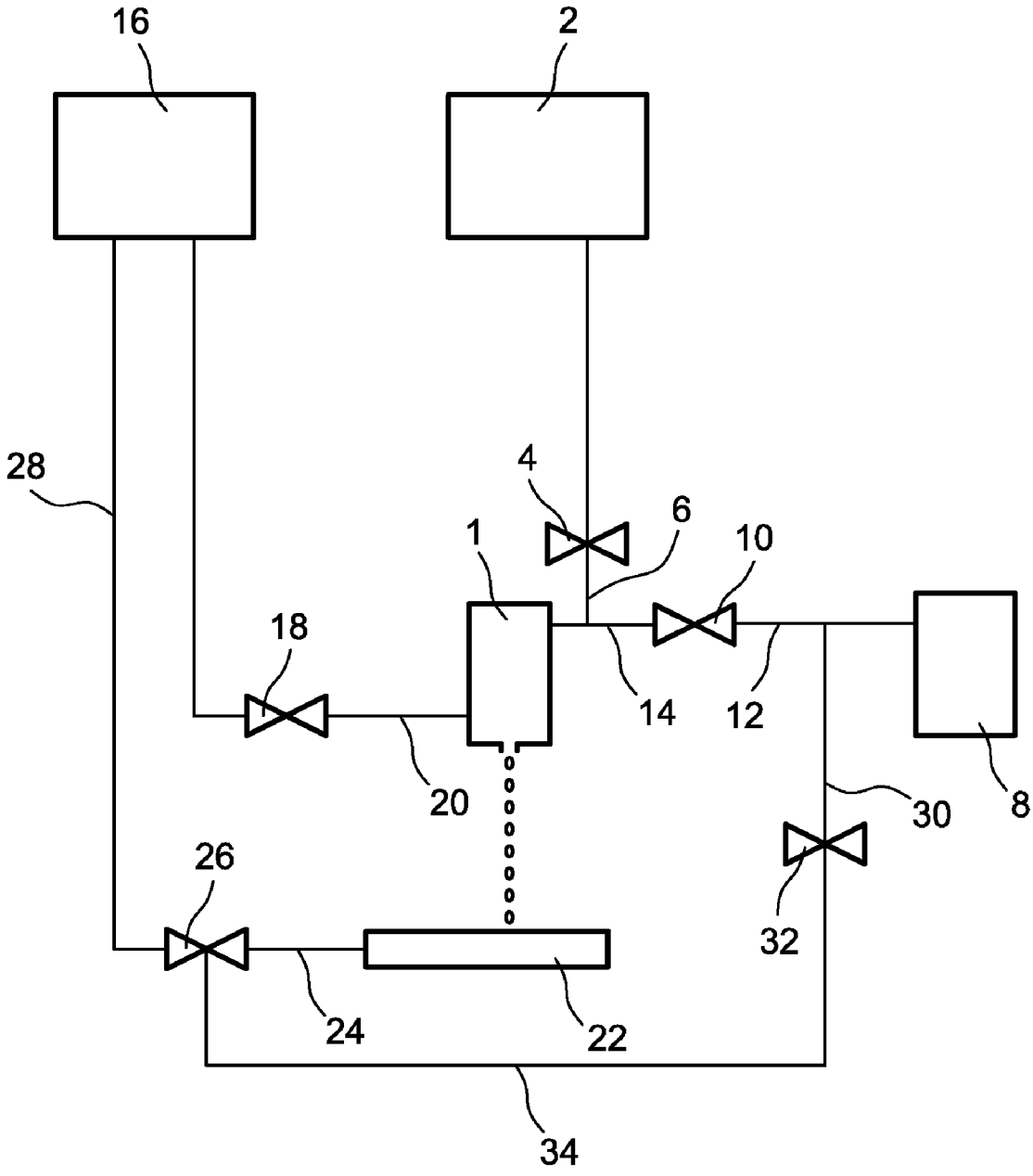
FIG. 1 is a hydraulic diagram of an ink jet printer capable of performing the method according to the invention.

FIG. 1 is a hydraulic diagram of an ink jet printer capable of being cleaned according to the method of the invention. This diagram shows only the conduits and solenoids enabling a connection to be established between an ink gun and a collection gutter, and an ink chamber, a vacuum source and a solvent chamber. However, as it will become clear, modifications are possible, in particular, for example, by the adaptation of a print head with two nozzles.

This ink jet printer comprises at least one ink gun 1 including a chamber and an ink stimulation device, connected by an ejection passage to a nozzle plate which comprises at least one ink jet ejection nozzle. The gun 1 is connected to the ink chamber 2 via an ink solenoid 4 and a conduit 6, of which a portion is located between the ink solenoid 4 and the gun 1. The conduit 6 advantageously leads to the stimulation chamber on a side opposite the nozzle plate, so as enable uniform filling; in particular, a connection is established between the conduit 6 and the stimulation chamber of the gun 1 by an opening located at an end of a side wall.

The gun is connected to a solvent chamber 8 via a solenoid 10 for washing the gun 1; this solvent chamber 8 can have any shape, such as a rigid cartridge or a flexible bag; it can be sealed or open. A conduit 12 connects the solvent chamber 8 to the solenoid 10 and a conduit 14 connects the solenoid 10 to the gun 1. Conduit 14 and conduit 6 advantageously lead to the same place in the stimulation chamber of the gun 1, that is, downstream of the two solenoids 4, 10, the solvent and ink conduits 14, 6 form a Y-junction; as described more clearly below, it is especially preferable for the solvent conduit 14 to be connected to the supply conduit 6 as close as possible to the ink solenoid 4 so as to enable the conduit 6 to be cleaned as well.

The gun 1 is finally connected to a vacuum source 16 via a discharge solenoid 18 and a conduit 20, a portion of which being located between the gun 1 and the discharge solenoid 18. The vacuum source 16 can consist of a pumping system connected, for example, to a collection chamber, possibly the ink chamber 2 (similarly to the solution in document EP-A-0 424 008 (Linx Printing Technology)); the vacuum source can preferably consist of a vacuum source 16 connected to the solenoid 18 wherein pressure is lower than in the gun 1. To ensure optimal cleaning, the conduit 20 leading to the vacuum source 16 is located as close as possible to the ejection nozzle of the gun 1, opposite the inflow conduit 14 of the solvent. The conduit 20 can be secured to the stimulation chamber of the gun 1 at the level of a side wall; the gun 1 is advantageously designed so that the conduit 20 leads to the level of the nozzle plate, near its ejection opening(s), for example by providing a recess in said plate.

An ink jet projected by the gun 1 through the plate is directed so that the drops from said jet, which are not directed toward a print substrate, are directed toward a collection gutter 22.

The gutter 22 is connected by a gutter way to the vacuum source 16. The gutter way comprises an upstream conduit 24 between the gutter 22 and a collection solenoid 26 and a downstream conduit 28 between the collection solenoid 26 and the vacuum source 16.

The solvent chamber 8 is connected to the gutter 22 via a conduit 30, a solenoid 32 for washing the collection gutter, a conduit 34 between the solenoid 32 for washing the collection gutter and the collection solenoid 26. The conduit 30 between the solenoid 32 for washing the collection gutter and the solvent chamber 8 is preferably connected directly to the solvent conduit 12 leading to the gun 1.

An example of the cleaning operation of this printer will now be described in relation to FIG. 2, which shows time charts of the opening and closing of the various solenoids: a logical value of 1 means that the corresponding solenoid is open, and a logical value of 0 means that it is closed; the solenoids are referenced at the right. The durations and periodicities of each phase can be modified according to the use and the print head concerned.

Figure 2A:
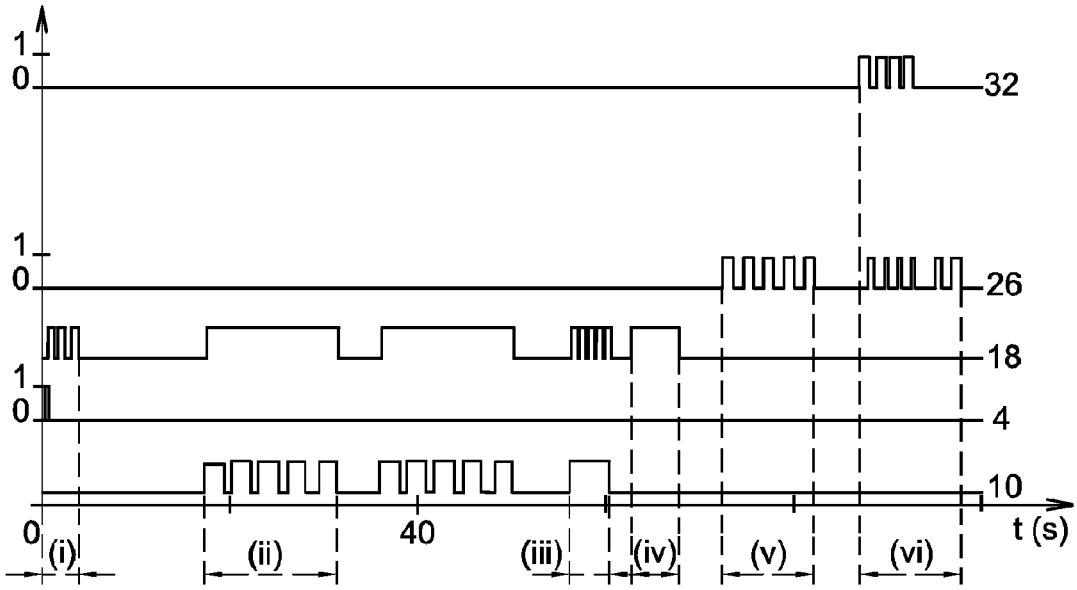
FIGS. 2A and 2B show time charts of the opening and closing of various solenoids of the circuit shown in FIG. 1, when the printer is stopped and when the ink jet is started up, respectively.

FIG. 2A relates to the initiation of the rinsing of the gun with a solvent after printing, and therefore starts up when the ink ejection stops. The ink solenoid 4 is closed, and the gun 1 is no longer supplied with pressurized ink, but the portion 6 of the supply conduit and the stimulation chamber are filled with ink.

During a first phase of washing the gun 1, the discharge solenoid 18 is opened. It is possible, as shown, in a first step (i), to perform a discharge by applying "vacuum order" (i.e. lower than atmospheric pressure) to the gun, by repeatedly opening and closing the discharge solenoid 18, the conduit portion 6 and the stimulation chamber being subjected to atmospheric pressure, or even lower. The actual washing phase involves a sequence (ii) in which the discharge solenoid 18 is open, while the solenoid 10 for washing the gun 1 is opened and closed periodically.

During the periods when the solenoid 10 for washing the gun is open, solvent is suctioned from the solvent chamber 8 to the vacuum source 16 through the solenoid 10, the stimulation chamber of the gun 1 and the discharge solenoid 18. As explained above, due to the vacuum in the gun 1, the solvent does not flow through the nozzle. During the periods when the solenoid 10 for washing the gun is closed, the solvent cannot reach the gun 1, which has been emptied of solvent.

Thus, the openings and closings (ii) of the solenoid 10 for washing the gun while the discharge solenoid 18 is open correspond to alternations in which the solvent fills and is emptied from the gun 1 and the portion of the conduit 6 between the ink solenoid 4 and the gun 1, so as to clean it. This sequence (ii) is preferably repeated.

During a nozzle-cleaning phase (iii), the solenoid 10 for washing the gun and the discharge solenoid 18 are open, so that the solvent circulates from the solvent chamber 8 to the vacuum source 16 through the solenoid 10, the gun 1 and the discharge solenoid 18.

While the solenoid 10 remains open, the discharge solenoid 18 is closed for very short periods shown by very brief returns to 0 on line 18 of FIG. 2A. Thus, sudden peaks of solvent pressure are created in the gun 1. Due to these sudden peaks, some solvent flows within the nozzle and cleans it, but the amount of solvent is just sufficient to moisten the nozzle's inside while remaining insufficient to create an ejected drop. By repeating the process several times, the nozzle is moistened and the moistened ink is suctioned without ejection of solvent.

When the nozzle is cleaned, the discharge solenoid 18 is open while the other solenoids 4, 10, 26, 32 are closed: the gun 1 is emptied of the solvent that it contained, and the washing is completed.

Although it is not essential, the method according to the invention can also include a step of washing the collection gutter 22. In a first phase (v) of cleaning the collection conduits, the collection solenoid 26 is open, preferably with a jerking motion, so as to direct the ink remaining in the gutter 22 toward the vacuum source 16.

In a second phase (vi) of washing the collection gutter, the actual cleaning is performed with the solvent. To this end, at the same time as the collection solenoid 26 is closed, the solenoid 32 for washing the collection gutter is opened. The vacuum is still adequate for solvent to be suctioned from the solvent chamber 8 to the gutter 22 through the solenoid 32 for washing the collection gutter and solenoid 26. At the same time as the solenoid 32 for washing the collection gutter is closed, the collection solenoid 26 is reopened, so that the solvent remaining in the gutter 22 is suctioned: the gutter 22 is cleaned. This sequence is advantageously repeated.

The gun 1, the nozzle, the gutter 22 and the various conduits that are subjected to variations in pressure are thus cleaned without the use of a solvent jet. The total cleaning advantageously lasts about 100 seconds.

When the printer remains off, it is preferable for the gun to remain empty during the shut-down period.

Depending on the duration of the shut-down of the printer, when the printing is restarted, it may be recommended to perform a solvent run, similar to a second cleaning, before activating the ink circuit. In addition, such a preliminary step can make it possible to check the operation status of the collection solenoid 26, so as to prevent any overflow of the gutter 22 during printing.

Figure 2B:
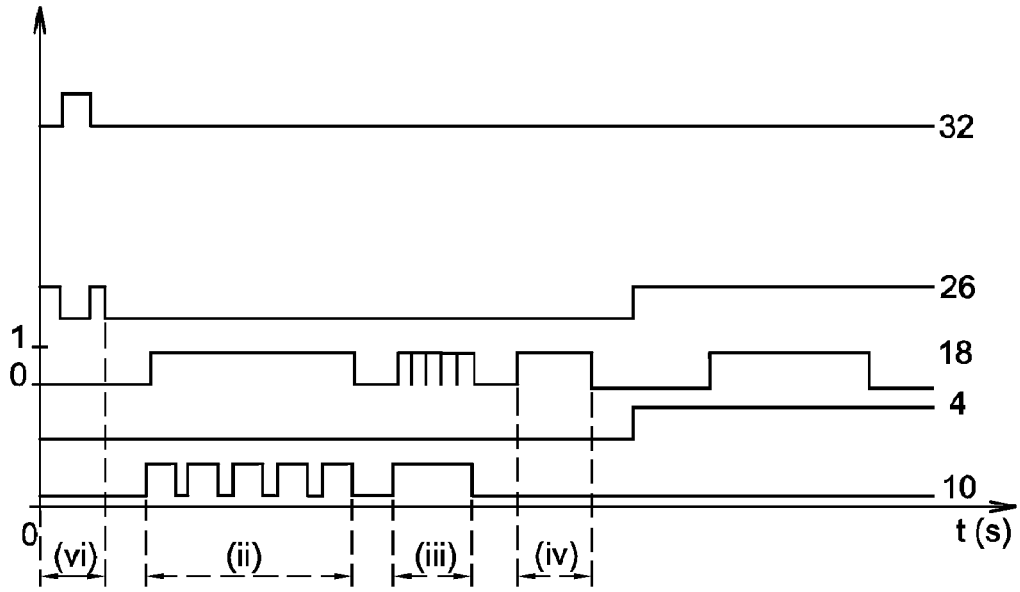

As shown in FIG. 2B, a method similar to that described above can be performed, but it can be shortened. In particular, steps (ii) of cleaning the gun, or (vi) of washing the collection gutter may be carried out a single time. In addition, it is noted that it may be preferable to first perform the washing of the gutter 22, before circulating solvent through the gun 1. This sequence can advantageously last around 40 s.

The solenoid 4 through which ink enters the gun 1 can be open, like the solenoid 26 for draining the gutter 22, and the printing can start.

This second rinsing in FIG. 2B can be omitted, in particular if the shut-down period is very short.

For better security if solvent remains in the gun 1, that is if the draining (vi) is not complete after the cleaning process, it may be desirable to gradually replace the solvent with ink in the gun 1. For example, the discharge solenoid 18 is first activated, which places the inside of the gun 1 in a vacuum, and at least a portion of the solvent is suctioned into the vacuum source 16. The ink solenoid 4 is then repeatedly briefly opened, which connects the ink chamber 2 to the gun 1, and causes the ink to circulate until it reaches the conduit 20, without establishing a jet through the nozzle owing to the opening of the discharge solenoid 18. During these opening-closing cycles of the ink solenoid 4, the proportion of ink in the gun 1 with respect to solvent increases. When it is considered that only ink is in the gun 1, the ink solenoid 4 and discharge solenoid 18 solenoids are closed. The printing machine is thus ready for a new printing cycle, the gun 1 being filled with pressurized ink.

Figure 3A:
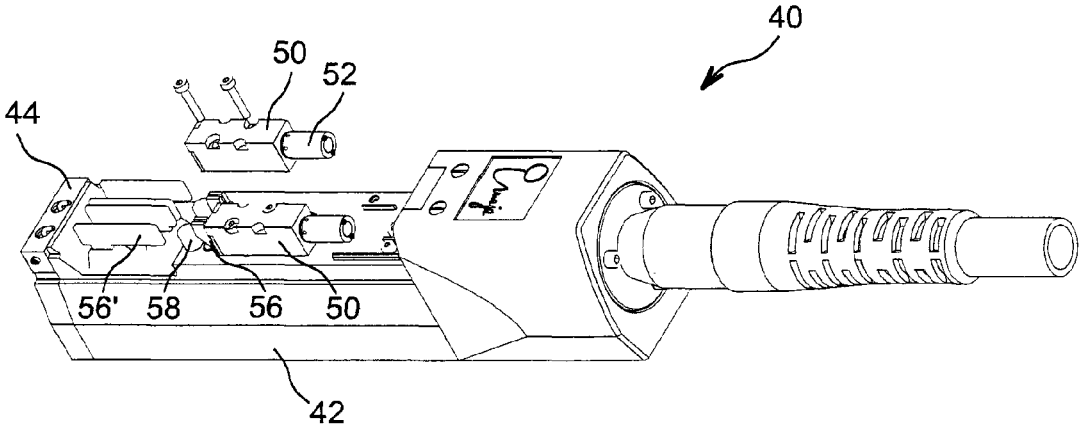
FIGS. 3A and 3B are diagrammatic perspective views, shown in two different directions, of a print head particularly suitable for performing the method of the invention.
Figure 3B:
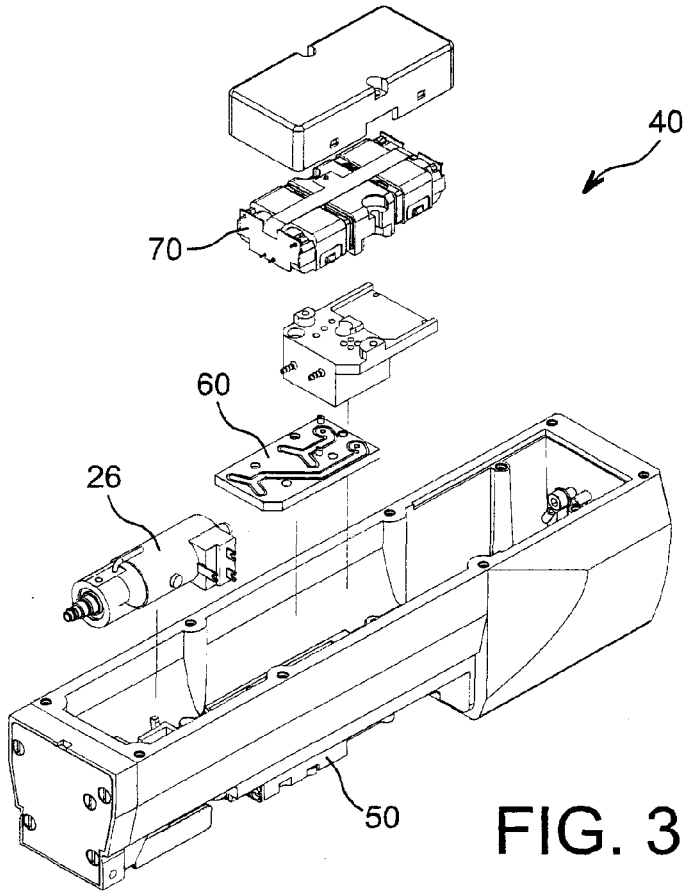

Although the methods for cleaning and starting up a print head as described above are suitable for any print head, these methods are particularly adapted to double nozzle print heads, an example of which being illustrated in FIG. 3.

The print head 40 thus comprises a casing 42 with one or more gutters 44 to collect ink and wherein two guns 50 comprising a reservoir and a stimulation device 52, here a piezoelectric device, are located. According to the embodiment, the nozzles 54 of each gun 50 can or cannot have convergent axis to the gutter(s) 44. To each gun 50 are associated a pair of charging electrodes 56, a sensor to detect charge 58 and a pair of deflecting electrodes 56'.

The casing 42 also includes the other necessary elements, in particular the gutter solenoid 26, the hydraulic circuits 60 and the other solenoids. According to the invention, it is advantageously possible to house all of the solenoids 4, 10, 18, 32, except perhaps the gutter solenoid 26, in the same compartment 70. Thus, maximum compactness of the head 40 is obtained, allowing for a simple assembly.

In particular, it is possible, in a head according to the invention, to position the second compartment 70 adjacent to the first compartment for housing the guns 50. Because the solenoids 4, 10, 18, 32 and the gun 1 are housed in adjacent compartments in the body of the print head 40, the conduit 6 between the ink solenoid 4 and the gun; the conduit 14 between the solenoid 10 for washing the gun and the gun 1, the conduit 20 between the discharge solenoid 18 and the gun 1, and the conduit 30 between the solvent source 8 and the solenoid 32 for washing the collection gutter, can be shorter, specifically of the order of several millimeters. These short conduits are preferably formed as passages in a support or casing 60. As the conduits are short, their volume is small; moreover, it is perfectly known. This means that after the washing time chart has been developed, it can be reproduced from one print head 40 to another, and from one gun 50 to another.

Furthermore, it is possible to produce a hydraulic circuit that is (exactly) identical for each gun 50, which enables the printing to be optimised.

The solenoids, which can be replaced by any connection control device, 4, 10, 18, 26, 32, are advantageously controlled by means of a control device housed in the print head 40. In addition, it is possible to provide sensors, in particular in each chamber 2, 8, 16, for closed-loop control of the solenoid control time charts.

In particular, if the solvent chamber 8 is sealed, during the washings, the vacuum in the solvent circuit 12, 14, 30, 34 may be modified. To compensate for the pressure difference created, the time charts can be modified by using the information provided by the pressure sensors. With a head according to the invention, the modifications can be (exactly) identical for both guns 50, and therefore for each of the ink jets.

Similarly, if the print head 40 must be mounted so that it is at different height than the solvent chamber 8, it is possible to modify the time charts so as to remove the effect of the pressure differences between each of the guns 50 and the suction 16 and solvent 8 chambers, respectively.

According to the method and device of the invention, it is thus possible to optimise the solvent consumption in the cleaning of print heads, and to keep this consumption constant, by modifying the solenoid opening and closing sequences, throughout the use of the print head. In addition, the amount of solvent for cleaning the head is very low: it can be recirculated directly through the hydraulic circuit of the printer, without requiring a waste chamber.

The invention claimed is:

1. Method for cleaning a print head of an ink jet printer comprising at least one ink gun with an ejection nozzle, an ink collection gutter, an ink chamber, a solvent chamber, a vacuum source, wherein each of the chambers and source are hydraulically connected, by means of a device capable of being controlled, to the ink gun, comprising the following sequence of:

interruption of a hydraulic connection between the gun and the ink chamber so that the ink gun is no longer supplied with ink, establishment of a hydraulic connection between the gun and the vacuum source, so that the ink in the gun is suctioned toward the vacuum source, establishment of a connection between the solvent chamber and the vacuum source via a hydraulic circuit comprising the ink gun, but not flowing through the nozzle, so that the gun is cleaned without ejection of solvent through the nozzle.

2. Method according to claim 1, wherein when the connection is established between the solvent chamber and the vacuum source, the connection between the solvent chamber and the ink gun is periodically interrupted, so that the gun is emptied each time of the solvent that it contains.

3. Method according to claim 1, wherein, when the connection is established between the solvent chamber and the vacuum source, the connection between the ink gun and the vacuum source is interrupted and separated from a re-establishment of the connection at least one time.

4. Method according to claim 3, wherein the interruption of the connection between the ink gun and the vacuum source is performed at least 3 times.

5. Method according to claim 1 wherein the ink collection gutter is hydraulically connected to a vacuum source by means of a device that can be controlled, and including the steps of:

establishing a connection between the collection gutter and the vacuum source, interrupting said connection between the collection gutter and the vacuum source and simultaneously establishing a connection between the collection gutter and the solvent chamber for a short time, establishing a new connection between the collection gutter and the vacuum source.

6. Method according to claim 5, wherein the interruption of said connection between the collection gutter and the vacuum source and the simultaneous establishment of a connection between the collection gutter and the solvent chamber for a short time are repeated several times.

7. Method according to claim 5, wherein the gutter is connected to the same vacuum source as the gun.

8. Method for turning on a print head of an ink jet printer comprising at least one ink gun, an ink collection gutter, an ink chamber, a solvent chamber, a vacuum source, wherein each of the chambers and source is hydraulically connected, by means of a device capable of being controlled, to the ink gun, including the steps of:

(1) cleaning the head by a method according to claim 1, (2) connecting the gun to the vacuum source, (3) alternating periods in which a connection is established between the gun and the ink chamber with periods in which this connection is interrupted, (4) activating the connection between the gun and the vacuum source and keeping the connection between the ink chamber and the gun open.

9. Printer print head comprising a first compartment housing at least one ink gun equipped with an ejection nozzle, at least one collection gutter, characterised in that it includes, for each gun:

a solenoid for washing the gun controlling a direct connection, not including the nozzle, between a solvent chamber and the gun, a discharge solenoid controlling a connection between the gun and a vacuum source, and an ink solenoid controlling a connection between an ink chamber and the gun.

10. Print head according to claim 9, comprising two ink guns intended to eject ink through a nozzle in the same direction.

11. Print head according to claim 10, wherein two ejection nozzles have an axis converging at a point in a gutter.

12. Print head according to claim 9, comprising a second compartment housing the solenoid for washing the gun, the discharge solenoid and the ink solenoid.

13. Print head according to claim 12, comprising a casing for hydraulic circuits, adjacent to the first and second compartments.

14. Print head according to claim 9, further comprising collection solenoid controlling a connection between a vacuum source and each collection gutter, and a solenoid for washing the collection gutter, controlling a connection between each collection gutter and a solvent chamber.

15. Print head according to claim 12, further comprising a collection solenoid controlling a connection between a vacuum source and each collection gutter, and a solenoid for washing the collection gutter, located in the second compartment and controlling a connection between each collection gutter and a solvent chamber.

* * * * *

UNITED STATES PATENT AND TRADEMARK OFFICE

CERTIFICATE OF CORRECTION

PATENT NO. : 7,874,636 B2
APPLICATION NO. : 11/722559
DATED : January 25, 2011
INVENTOR(S) : Max Perrin and Daniel Chalamet It is certified that error appears in the above-identified patent and that said Letters Patent is hereby corrected as shown below:

On title page, Inventors (75) , please delete "Toumon" and insert therefor --Tournon--.

Signed and Sealed this
Twelfth Day of April, 2011

David J. Kappos

David J. Kappos
*Director of the United States Patent and Trademark Office*